US008225862B2

(12) United States Patent
Xu

(10) Patent No.: US 8,225,862 B2
(45) Date of Patent: Jul. 24, 2012

(54) LOAD DISTRIBUTING APPARATUS AND METHOD

(75) Inventor: Richard Y. Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 321 days.

(21) Appl. No.: 12/545,388

(22) Filed: Aug. 21, 2009

(65) Prior Publication Data

US 2011/0042103 A1 Feb. 24, 2011

(51) Int. Cl.
*E21B 40/00* (2006.01)

(52) U.S. Cl. ..... 166/209; 166/216; 166/217

(58) Field of Classification Search ..... 166/207, 166/209, 216, 217, 382, 117, 179, 387, 107, 166/106

See application file for complete search history.

(56) References Cited

U.S. PATENT DOCUMENTS

| | | | | |
|---|---|---|---|---|
| 5,603,511 | A * | 2/1997 | Keyser et al. | 277/337 |
| 2006/0124295 | A1 * | 6/2006 | Maguire | 166/207 |
| 2009/0321065 | A1 * | 12/2009 | Vinson et al. | 166/101 |

OTHER PUBLICATIONS

B. Hlavacek et all, "Thermodynamic Aspects of Using Polymer Additives in Waterflooding"; Society of Petroleum Engineers, Paper No. SPE 6649; 1977.

Bruce E. Urband et al., "The Effects of OCTG Connection Swaging and Stress Relieving on SSC Resistance"; Corrosion 2003; Paper No. 03111; NACE International.

Jim R. Williamson et al., "An Infinitely Variable Choke for Multi-Zone Intelligent Well Completions"; Society of Petroleum Engineers, Paper No. SPE 64280; Oct. 16, 2000.

* cited by examiner

*Primary Examiner* — Daniel P Stephenson
*Assistant Examiner* — Yong-Suk Ro
(74) *Attorney, Agent, or Firm* — Cantor Colburn LLP

(57) ABSTRACT

A load distributing apparatus including, a sleeve configured to be radially expandable, and a wedge in operable communication with the sleeve. The longitudinal movement of the wedge relative to the sleeve causes an increase in longitudinal load on the sleeve by the wedge until an expanded portion of the sleeve reaches a selected dimension of the wedge after which continued movement of the wedge relative to the sleeve maintains a substantially constant longitudinal load on the sleeve.

19 Claims, 3 Drawing Sheets

LOAD DISTRIBUTING APPARATUS AND METHOD

BACKGROUND

Tools, such as tubular tools used in the downhole hydrocarbon recovery and carbon sequestration industries, for example, typically use longitudinal loading for setting thereof. Excessive loading, however, of a tool, after the tool has been set, can cause damage to the tool.

Additionally, in some applications it may be advantageous to set two or more tools with a single longitudinal movement. In such applications, however, the single longitudinal movement can cause excessive loading on one tool while providing insufficient loading on another tool.

Apparatuses and methods to overcome the foregoing drawbacks are desirable in the art.

BRIEF DESCRIPTION

Disclosed herein is a load distributing apparatus. The apparatus includes, a sleeve configured to be radially expandable, and a wedge in operable communication with the sleeve such that longitudinal movement of the wedge relative to the sleeve causes an increase in longitudinal load on the sleeve by the wedge until an expanded portion of the sleeve reaches a selected dimension of the wedge after which continued movement of the wedge relative to the sleeve maintains a substantially constant longitudinal load on the sleeve.

Further disclosed herein is a method of distributing loads. The method includes, longitudinally moving a wedge relative to a sleeve, increasing longitudinal loading on the sleeve with the wedge, expanding the sleeve with the wedge, maintaining a substantially constant load on the sleeve with the wedge, and continuing moving the wedge relative to the sleeve.

Further disclosed herein is a method of setting tools. The method includes, longitudinally loading a sleeve with a wedge, setting a first tool with the longitudinal loading on the sleeve, longitudinally moving the wedge relative to the sleeve, expanding the sleeve with the wedge, and setting a second tool with the longitudinal moving of the wedge.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
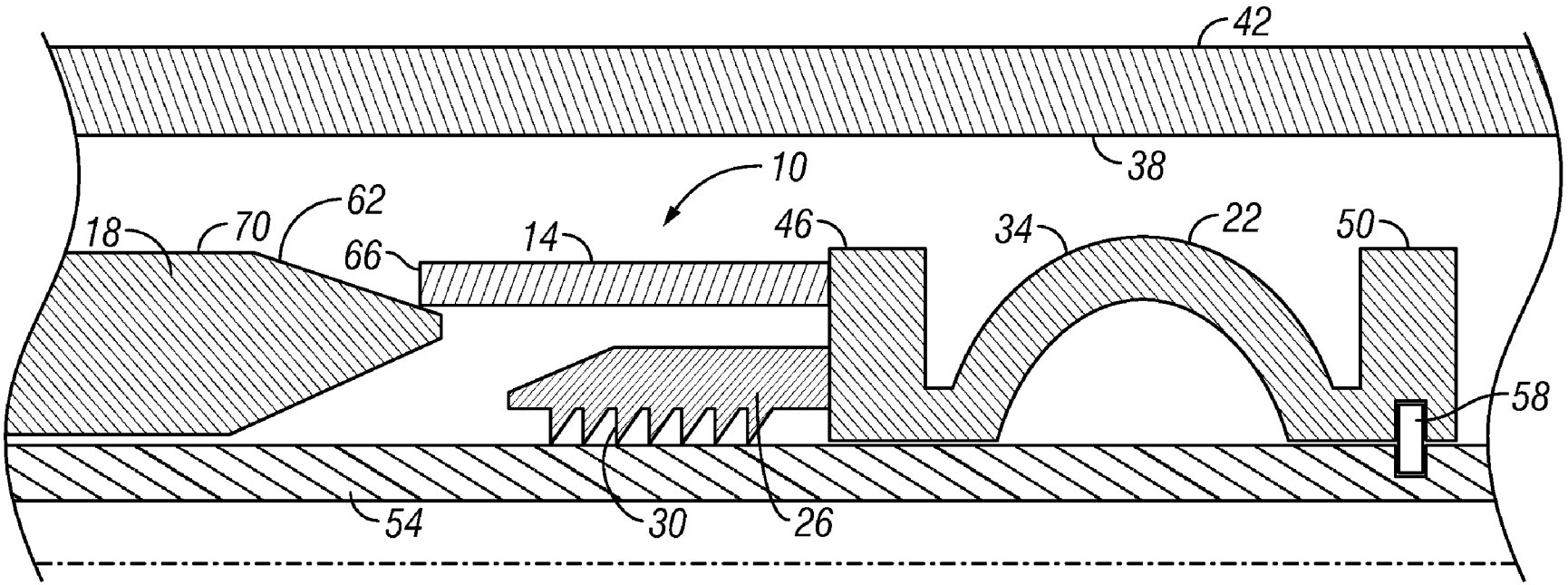
FIG. 1 depicts a partial cross sectional view of a load distributing apparatus disclosed herein prior to setting tools engaged therewith.
Figure 2:
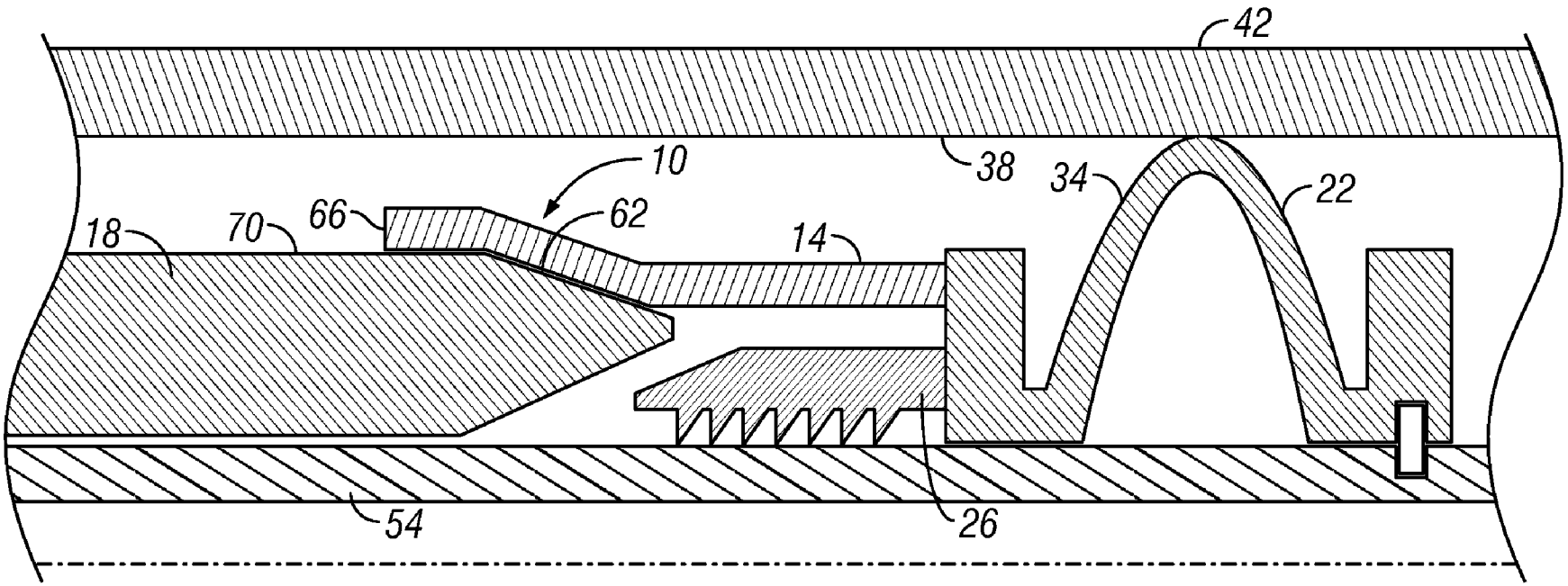
FIG. 2 depicts a partial cross sectional view of the load distributing apparatus of FIG. 1 after setting of a first tool and prior to setting of a second tool.

Referring to FIGS. 1 and 2, an embodiment of a load distributing apparatus disclosed herein is generally illustrated at 10. As will be described below the load distributing apparatus 10 can be used to set a tool in a way that prevents backlash. The load distributing apparatus 10 includes, a sleeve 14 that is radially expandable, and a wedge 18, depicted herein as a tubular, that is configured to radially expand the sleeve 14 in response to longitudinal movement of the wedge 18 in relation to the sleeve 14. The sleeve 14 abuts a first tool 22, shown herein as a seal element that is settable in response to longitudinal loading thereof by the sleeve 14. A second tool 26, shown herein as an anchor with slips 30, is settable in response to longitudinal loading thereof by the wedge 18. Expansion of the sleeve 14, as the wedge 18 moves therethrough, limits the load imparted on the first tool 22 by the sleeve 14 thereby preventing overloading of the first tool 22 and any damage that could result from such overloading.

In FIG. 1 the first tool 22 is shown in an unset configuration, as such, seal 34 is not sealingly engaged with walls 38 of a structure 42 within which the first tool 22 is positioned. Loads imparted on a movable first end 46 of the first tool 22 by the sleeve 14 urges the first end 46 toward a second end 50 of the first tool 22 that is fixedly attached to a base tubular 54, in this embodiment, by a C-ring 58. Movement of the first end 46 toward the second end 50 causes the seal 34 to deform radially outwardly into sealing engagement with the wall 38 as illustrated in FIG. 2. Additionally, the second tool 26 is attached to the first end 46 and is also moved relative to the base tubular 54 as the first end 46 is moved under the urging load of the sleeve 14.

Contact between a first ramped surface 62 on the wedge 18 as the wedge 18 moves longitudinally toward the first tool 22 creates a longitudinal load on the sleeve 14 that is transmitted through the sleeve 14 to the first end 46. The load increases until the a leading edge 66 of the sleeve 14 encounters a non-ramped surface 70 of the wedge 18 shown in this embodiment as a cylindrical surface (as illustrated in FIG. 2) after which the longitudinal load on the sleeve 14 is substantially constant in response to continued movement of the wedge 18 into the sleeve 14. This constant load is due to the constant amount of radial expansion occurring to the sleeve 14 as the wedge 18 moves therethrough. The first tool 22 is configured to be set at a load less than the constant load to assure that full setting of the fist tool 22 is achieved before reaching the constant load. The first tool 22 is further configured to withstand the constant load without sustaining damage. As such, the wedge 18 can continue to move through the sleeve 14, thereby radially expanding more of the sleeve 14, without any detrimental effect to the first tool 22.

Figure 3:
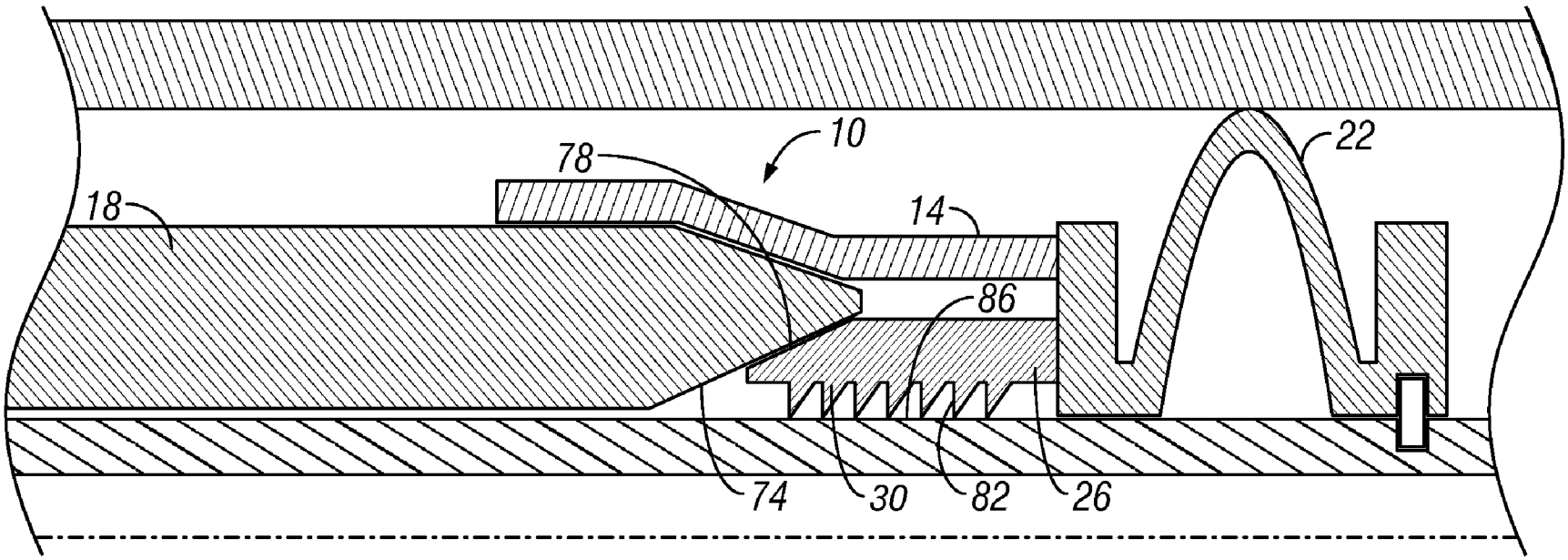
FIG. 3 depicts a partial cross sectional view of the load distributing apparatus of FIG. 1 after setting of both the first tool and the second tool.

Referring to FIG. 3, the wedge 18 continues to move through the sleeve 14 until a second ramped surface 74 on the wedge 18 contacts a tapered surface 78 on the second tool 26. After initiation of such contact additional movement of the wedge 18 causes teeth 82 on the slips 30 of the second tool 26 to frictionally engage with a surface 86 of the base tubular 54 thereby anchoring the second tool 26, the first tool 22 and the sleeve 14 to the base tubular 54 with no backlash and completing setting of the second tool 26.

The foregoing structure allows the load distributing apparatus 10 to active the first tool 22 with a first longitudinal load supplied by the sleeve 14 thereon, and then to set the second tool 26 while assuring that the first tool 22 does not experience loads in excess of a selected load defined by the load distributing apparatus 10.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A load distributing apparatus comprising:

a sleeve configured to be radially expandable;

a wedge in operable communication with the sleeve such that longitudinal movement of the wedge relative to the sleeve causes an increase in longitudinal load on the sleeve by the wedge until an expanded portion of the sleeve reaches a selected dimension of the wedge after which continued movement of the wedge relative to the sleeve maintains a substantially constant longitudinal load on the sleeve; and a first tool operatively arranged to be set longitudinally relative to the sleeve by the longitudinal load transferred through the sleeve to the first tool.

2. The load distributing apparatus of claim 1, wherein the wedge is a tubular.

3. The load distributing apparatus of claim 1, wherein the first tool is settable at a first longitudinal load less than the substantially constant longitudinal load.

4. The load distributing apparatus of claim 3, wherein the substantially constant longitudinal load is selected to be less than a second longitudinal load that would be detrimental to the first tool.

5. The load distributing apparatus of claim 3, wherein the wedge is configured to load a second tool to cause setting thereof.

6. The load distributing apparatus of claim 5, wherein the load distributing apparatus is configured to set at least one of the first tool and the second tool without backlash.

7. The load distributing apparatus of claim 1, wherein the sleeve is configured to set seals of a downhole annular seal and the wedge is configured to set slips of a downhole anchor.

8. The load distributing apparatus of claim 1, wherein the substantially constant longitudinal load is determined by the load required to expand the sleeve to the selected dimension of the wedge.

9. The load distributing apparatus of claim 1, wherein the selected dimension is a radial dimension.

10. The load distributing apparatus of claim 1, wherein the wedge includes a ramped surface with which the sleeve expandably engages.

11. A method of distributing loads comprising:

longitudinally moving a wedge relative to a sleeve;

increasing longitudinal loading on the sleeve with the wedge;

expanding the sleeve with the wedge;

maintaining a substantially constant longitudinal load on the sleeve with the wedge;

continuing moving the wedge relative to the sleeve; and setting a first tool longitudinally relative to the sleeve with the longitudinal loading transferred through the sleeve to the first tool.

12. The method of distributing loads of claim 11, further comprising limiting the longitudinal loading on the sleeve with the expanding the sleeve.

13. The method of distributing loads of claim 11, wherein the maintaining a substantially constant load on the sleeve with the wedge is due to a constant dimensional expansion of the sleeve with continued movement of the wedge relative to the sleeve.

14. The method of distributing loads of claim 11, wherein setting the first tool occurs before maintaining the substantially constant load.

15. A method of setting tools comprising:

longitudinally loading a sleeve with a wedge;

setting a first tool longitudinally relative to the sleeve with the longitudinal loading on the sleeve;

longitudinally moving the wedge relative to the sleeve;

expanding the sleeve with the wedge; and setting a second tool with the longitudinal moving of the wedge.

16. The method of setting tools of claim 15, further comprising limiting the longitudinal loading on the sleeve with the expanding of the sleeve.

17. The method of setting tools of claim 16, wherein the limiting of the longitudinal loading on the sleeve is due to a constant dimensional expansion of the sleeve with continued movement of the wedge relative to the sleeve.

18. The method of setting tools of claim 15, further comprising delaying setting of the second tool until after the longitudinal loading on the sleeve has been limited.

19. The method of setting tools of claim 15, further comprising maintaining setting of at least one of the first tool and the second tool without backlash.

* * * * *